United States Patent [19]

Delassus et al.

[11] 4,339,625

[45] Jul. 13, 1982

[54] ELECTRIC INDUCTION FURNACE WITH ELECTRICALLY DISCONTINUED COOLING SCREEN

[75] Inventors: Jean Delassus, Montmorency; Bertrand de Lamberterie; Jacques Michelet, both of Metz, all of France

[73] Assignee: Institut de Recherches de la Siderurgie Francaise (IRSID), Saint-Germain-en Laye, France

[21] Appl. No.: 150,992

[22] Filed: May 19, 1980

[30] Foreign Application Priority Data

May 23, 1979 [FR] France ..... 79 13428

[51] Int. Cl.[3] ..... H05B 6/42

[52] U.S. Cl. ..... 373/158; 219/10.49 R

[58] Field of Search ..... 219/10.49 R; 13/26, 13/27

[56] References Cited

U.S. PATENT DOCUMENTS 1,823,908 9/1931 Long ..... 13/26

2,848,566 8/1958 Limpel ..... 219/10.49

*Primary Examiner*—Bernard Roskoski

*Attorney, Agent, or Firm*—Michael J. Striker

[57] ABSTRACT

An electric furnace for induction heating of metallic products comprises a planar inductor providing a sliding magnetic field, the inductor being incorporated in a pair of transversely spaced walls defining between themselves a space into which the product to be heated is inserted, a layer of refractory material at that side of each wall which borders the space and an independent cooling screen sandwiched between each wall and the respective layer of refractory material, in which the screen is constituted by a plurality of parallel, adjacent metal tubes out of mutual contact with each other to define between themselves electrically insulating spaces, preferably filled with electrically insulating material, and in which the tubes extend normal to the flow of the primary current through the inductor. Preferably at least one of the walls together with the respective refractory layer and screen is movable toward and away from the other wall to accommodate metal products of different widths in the space.

7 Claims, 4 Drawing Figures

ELECTRIC INDUCTION FURNACE WITH ELECTRICALLY DISCONTINUED COOLING SCREEN

BACKGROUND OF THE INVENTION

The present invention relates to an electric furnace of variable geometry for induction heating of metallic products, especially products of large volume, such as steel billets, which are upright placed into the interior of the furnace.

A furnace of this type is described in the French Pat. No. 2,339,316. In this furnace the heating means is constituted by a planar inductor with a sliding magnetic field, which constitutes an essential element of at least one large wall of the furnace which is laterally movable. This inductor comprises bar-shaped electric conductors located in slots provided in a face of the magnetic yoke which is directed toward the interior of the furnace and in the following designated as "active face of the inductor".

One of the absolutely necessary features of such a furnace is to assure the maintenance of the temperature of the inductor at an acceptable level, in view of the thermic charge resulting from the internal heating and from the radiation of the product in the furnace.

This thermic protection of the inductor is obtained in the mentioned patent by the combined action of a refractory covering provided on the active face of the inductor and a cooling fluid circulated in the aforementioned slots.

Such a solution has its drawbacks if one considers for example that, in the case of an inductor with a sliding field, the air gap plays an important role for the electric output of the furnace, and that for this reason the thickness of the refractory covering has to be as small as possible.

A corresponding observation relates to the cooling in the slots, especially when, in accordance with the construction described in the aforementioned patent, the electrical conductors are bars of the type "Roebel", designed to facilitate the passage of currents of necessary high intensity. In this case, the possibility of cooling by internal circulation of cooling fluids is much more limited than for tubular conductors which are used for the heating by solenoids or other types of inductors with a stationary magnetic field.

According to a preferred realization described in the above-mentioned patent, the thermic protection of the inductor is accomplished by a circulation of cooling fluid in channels parallel to the bars, placed in front of the slots. Here too, certain difficulties may arise, for instance the difficulties of a practical construction since it is not at all simple to place such channels in the slots of the yoke, further difficulties of a mechanical nature due to the vibration of the inductor during passage of an alternating current therethrough, and the additional difficulty of electric nature since the channels extending parallel to the conductive bars may become the seat of parasitic Foucault currents.

SUMMARY OF THE INVENTION

It is an object of the present invention to provide an electric furnace of the aforementioned kind which avoids the disadvantages of such furnaces known in the art.

It is an additional object of the present invention to increase the efficiency of the cooling of the inductor heating the furnace.

With these and other objects in view, which will become apparent as the description proceeds, the electric furnace for induction heating of metallic products, especially of products of large volume, such as steel ingots or the like, mainly comprises a planar inductor providing a sliding magnetic field, in which the inductor is incorporated in a pair of parallel transversally spaced walls which define between themselves a space into which the product to be heated is inserted, a layer of refractory material at that side of each wall which borders the space, and an independent cooling screen sandwiched between each wall and the layer of refractory material, in which the screen has a composite structure representing a plurality of successive units which are electrically discontinued in the direction of the primary current of the inductor.

As understood, the present invention consists in replacing the cooling channels incorporated in the magnetic yoke of the inductor by an independent cooling screen masking the active face of the inductor and sandwiched between the latter and the refractory layer.

Nevertheless, arrangements have to be made to render the cooling screen as much as possible transparent for the magnetic field. In this respect it is advantageous to utilize for the fabrication of the screen a material presenting a weak electric conductivity and a relative magnetic permeability in the neighborhood of unity. Nevertheless, for obvious mechanical reasons, up to now only metal especially steel, can actually be considered, even though certain difficulties will arise for the transmission of the magnetic flux through the screen.

In order to overcome these difficulties and to obtain thus a cooling arrangement in form of a "thermic screen" without constituting also a "magnetic screen", a characteristic of the present invention consists of providing this screen with a composite structure, in order to present an electric discontinuity from one to the other structure in a direction parallel to the conductive bars of the inductor.

In this manner, the Foucault currents which, as known, have the tendency to form in a direction parallel to the primary current of the inductor, are to a large extent reduced and therewith the absorption of the magnetic field during passing through the screen is likewise reduced.

A possible construction consists of making the screen from alternating metallic and non-metallic bands, oriented normal to the conductive bars of the inductor.

A preferred construction according to the present invention resides in forming the cooling screen from metallic tubes located parallel, adjacent to each other, but without contact with each other in such a manner to form between consecutive tubes an electric insulating space, and in which the tubes are oriented normal to the conductive bars of the inductor.

These arrangements may be further improved, in order to function in the manner as mentioned above, by an appropriate choice of the metal from which the screen is formed, for instance by choosing for the metal non-magnetic stainless steel.

In an especially advantageous manner the screen may be formed from elementary units which are assembled in the furnace. Such a construction permits to prefabricate the units to standard dimensions and the number of the units used will depend on the dimension of the furnace.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
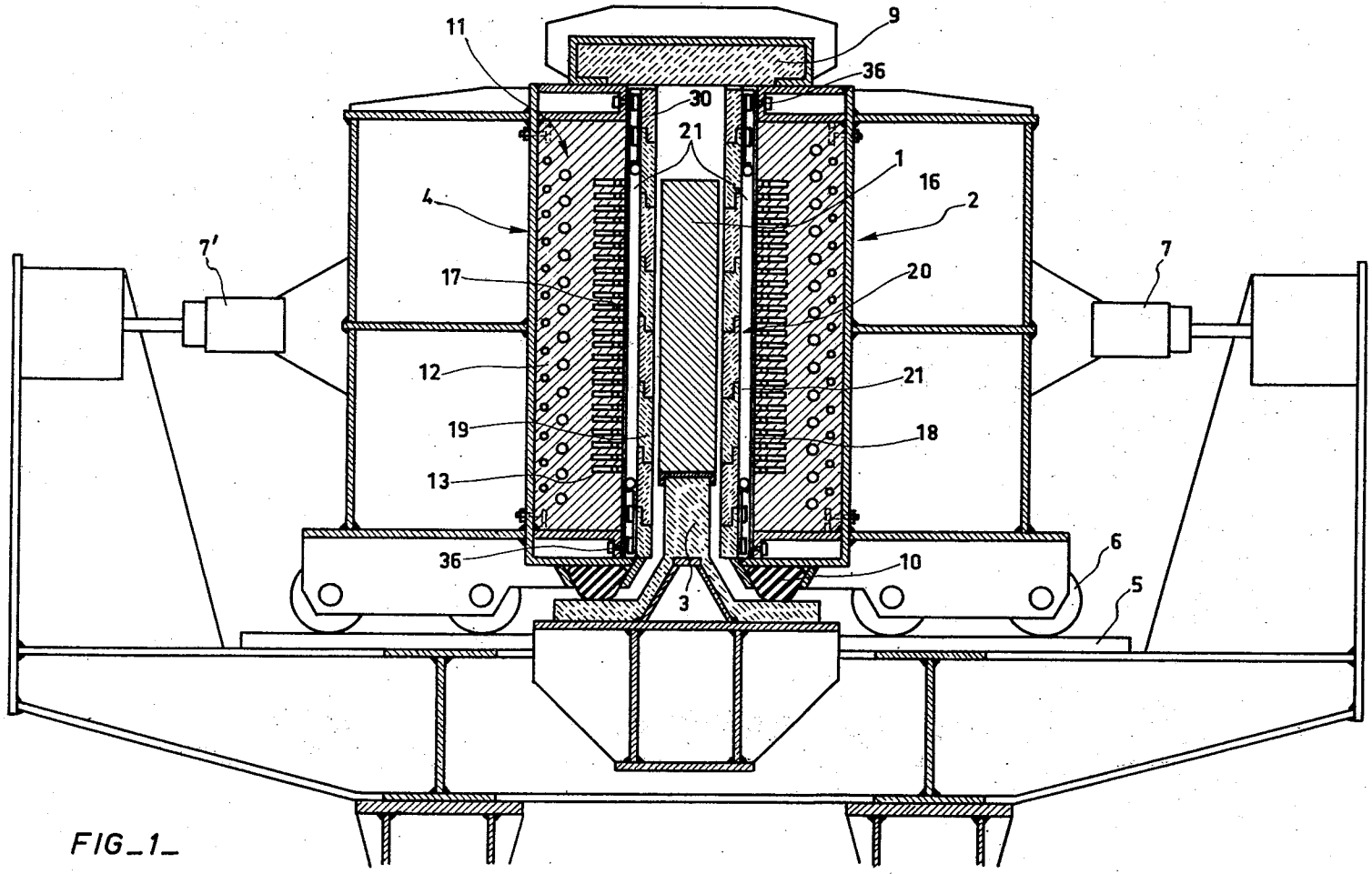
FIG. 1 is a vertical cross section taken normal to the plane of the walls of the inductor.
Figure 2:
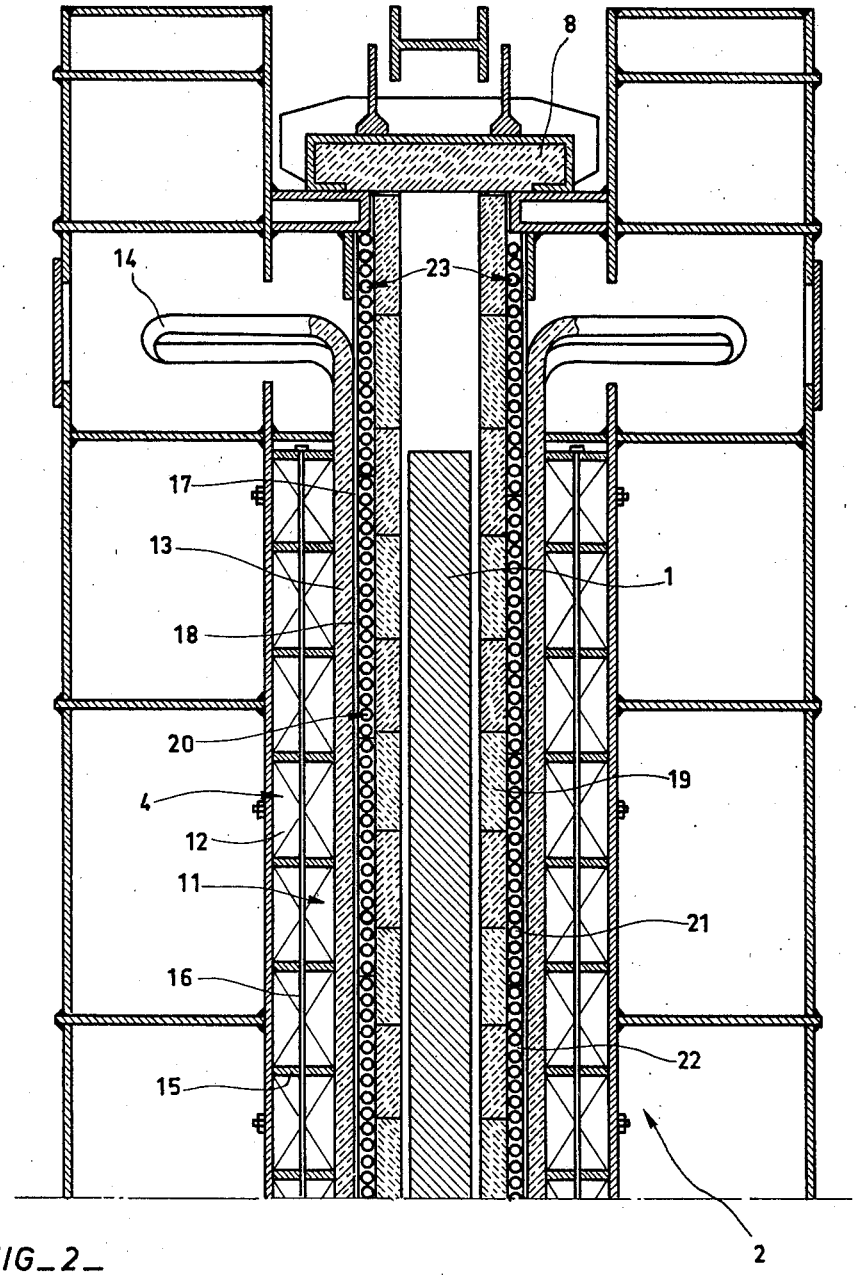
FIG. 2 is a horizontal cross section through the furnace.

Referring now to the drawing and more specifically to FIGS. 1 and 2 of the same, it will be seen that a steel billet 1 is uprightly supported in the interior of the furnace 2 by means of supporting pedestal 3. In order to adapt the geometry of the furnace to the size of the billet, the large lateral walls 4 of the furnace, facing the large faces of the billet, are movably supported on carriages having wheels 6 movable on rails 5 toward and away from each other. The aforementioned carriages are moved by preferably hydraulically operated jacks 7, 7' operatively connected thereto. The closure of the interior space to be heated is laterally completed by two small closures of refractory material 8, of which only one is shown in FIG. 2, whereas the upper end of the space is closed by a cover of refractory material 9 and the airtightness of the space at the lower end is assured by compression of an elastic coupling member 10 under the action of the pedestal 3, which is movable by conventional means, not shown in the drawing, toward the cover 9.

As clearly illustrated in FIG. 1, the large lateral walls 4 of the furnace are essentially constituted by a planar electromagnetic inductor 11. The inductor 11 is formed by a magnetic yoke 12 laminated in vertical direction and presenting, at the side of the billet 1, horizontal slots in which bars 13 of the type "Roebel" for the passage of electric current are located.

These bars 13 are connected in the known manner to a supply of polyphase current, not illustrated in the drawing, (for example, a three-phase current), in order to produce in the interior of the furnace a vertically sliding magnetic field.

The bar-shaped conductors 13 are best visible in FIG. 2, in which also the curved end portions 14 of the same are shown, which permit the series connection of the bars, which are to be connected to the same phase of the network.

It is to be noted that in order to absorb the vibration energy caused during passage of an alternative current through the conductors 13, the magnetic yoke 12 is divided into a plurality of elementary blocks separated by plates 15 of relative soft material, such as aluminum, and the various elements of the assembly are held in abutting relationship by tension rods 16. Furthermore, in order to hold the bars 13 in place, an elastic elongated support 17 is placed at the open ends of the slots. If desired, a further detailed description of the construction of the inductor for the furnace in general may be found in the French Pat. No. 2,339,316 and in the first patent of addition thereto No. 2,354,015.

As can be seen from FIGS. 1 and 2, the inductor is equipped at its active face, designated with the reference numeral 18, with a refractory layer 19 and with a cooling screen 20 interposed between the active face of the inductor and the refractory layer 19. A composite structure of the cooling screen 20 according to the present invention, and a preferred form of realization thereof will be described in a non-limitative manner in detail below.

The screen 20 is constituted by a plurality of parallel metallic tubes 21 arranged adjacent, but out of mutual contact with each other, in a manner to define between the tubes electrically insulating spaces 22. The tubes 21 are oriented normal to the bar-shaped conductors 13, that is vertical in the described example. In order to render the assembly rigid, the spaces 22 are preferably filled by an appropriate material of heat and electrical insulating property, for example a material commercially available under the name "Syndanio", composed of a mixture of small stones and asbestos pressed together under considerable force.

This composite structure of the screen 20 and its orientation with respect to the bar-shaped conductors 13 aims, as already mentioned above, to prevent the development of undesirable Foucault currents.

It is to be understood, that the screen 20 forms part of a cooling circuit (not shown in the drawing) in order to circulate a cooling fluid, for instance water, through the tubes.

Figure 3:
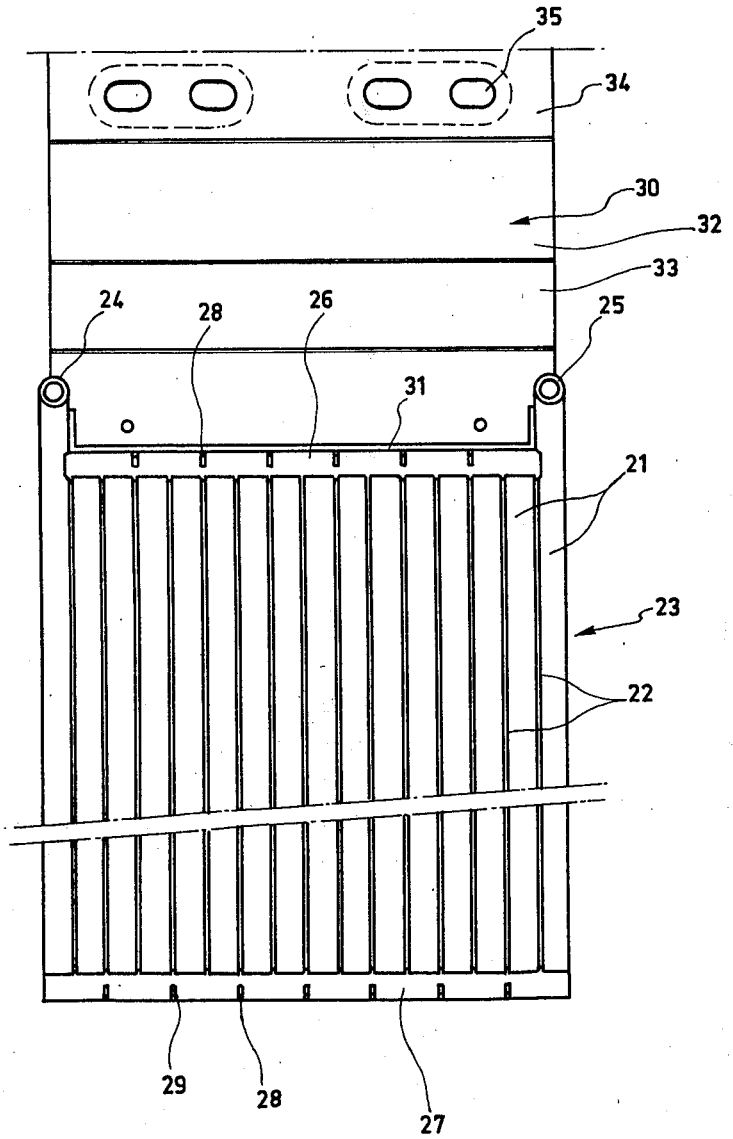
FIG. 3 is a front view of one elementary unit constituting the cooling screen according to the invention.
Figure 4:
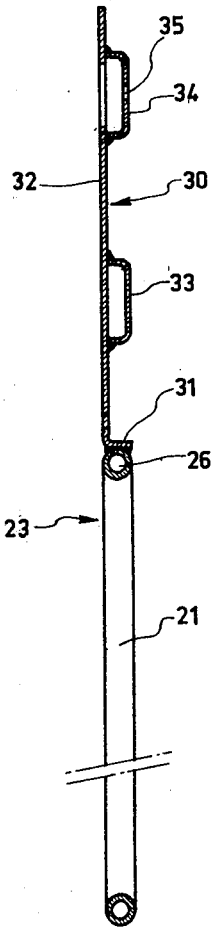
FIG. 4 is a vertical cross section through this unit.

According to a preferred embodiment, the screen 20 is constructed from an assembly of elementary cooling units, indicated with the reference numeral 23 and one of these units is illustrated in FIGS. 3 and 4.

As shown in FIGS. 3 and 4, each unit 23 comprises an inlet tube 24 and outlet tube 25 for the circulation of the cooling water through the unit.

For this purpose, the tubes 21 belonging to the same unit 23 are mounted in parallel and preferably connected in series, as shown in FIG. 3. In this case, the unit 23 constitutes a cooling coil in which the water circulates successively through each of the tubes 21, which permits the best absorption of the thermic flow.

It can be seen, the tubes 21 communicate at their opposite ends by means of a transverse upper tube 26 and a transverse lower tube 27, respectively. This particular arrangement is of interest since it permits to arrive from a parallel arrangement of the tubes to an arrangement in which the tubes are connected in series, without requiring an important modification. As clearly shown in FIG. 3, in order to arrive from the parallel arrangement to a series arrangement, it is sufficient to obstruct the flow of fluid through the transverse conduits 26 and 27 at proper places, that is between two adjacent tubes 21 and at a distance from each other corresponding to a pair of tubes and wherein the locations of the obturations in the upper transverse tube 26 are shifted with respect to those in the lower transverse tube 27.

These obturations may be realized simply, as shown in FIG. 3, by means of small platelets 28 placed in semi-annular slots 29 formed at appropriate places in the transverse tubes 26 and 27.

It will be noted that the inlet conduit 24 and the outlet conduit 25 are both located at the upper end of the screen, which simplifies the connection of inlet and outlet to the cooling circuit.

Some numerical dimensions of the structure of the cooling screen unit 23 are given below in a non-limiting manner.

The tubes 21 are preferably formed from stainless, non-magnetic steel and have an outer diameter of 15 mm and a thickness of 2 mm. It is preferred, for electromagnetic reasons, to choose the thickness of the tubes as small as possible, compatible with the requirement of the necessary mechanical strength of the screen, which may be improved as already pointed out, by placing into the spaces 22 some insulating support material.

The spaces 22 are held as small as possible, that is 2 mm in the described example. This value may be further reduced, the only condition being that the tubes are not in contact with each other in order to avoid an electric continuity in transverse direction. The length of the tubes is preferably smaller than the height of the active region of the inductor. This arrangement has the complementary advantage that the transverse tubes 26 and 27 are outside the air gap to thus avoid that the transverse tubes 26 and 27 become the location of Foucault currents.

The connection of the units 23 in the furnace is made with the aid of two identical connecting members which project vertically from opposite ends of the unit.

In FIGS. 3 and 4 only the upper connecting member 30 is illustrated. As can be seen, this connecting member is constituted by an L-shaped profile, the small branch 31 of which is soldered to the respective transverse tube and the large branch 32 of which, located in the plane of the inner surface of the screen, is provided with two U-shaped cross bars 33 and 34. The upper cross bar 34 is provided with a plurality of orifices 35 for the passage of connecting bolts therethrough, indicated with the reference numeral 36 in FIG. 1. In addition to the efficiency of the thermic protection of the inductor, the invention provides a number of further advantages, among which the following are mentioned:

the fact that the cooling screen is an autonomous element related to the furnace, but structurally independent from the inductor, permits a considerable simplification of its conception and facilitates its maintenance:

the efficiency of the screen for the thermic protection of the inductor is such that the thickness of the refractory cover may be substantially reduced, as compared to that of the known furnace described in the French Pat. No. 2,339,316. It is thus possible to reduce a thickness of the refractory cover from about 10 cm to about 3 cm. Taking into consideration the thickness of the screen (about 1.5 cm), a reduction of the air gap in the order of 5 cm will result, and this due to the possibility to adapt the geometry of the interior of the furnace to that of the product to be heated.

The reduction of the air gap entails the further advantages which are enumerated as follows:

an improvement of the cosine $\phi$ of the installation. In this respect experience has shown that the cosine $\phi$ of the known furnace described in the above-mentioned French patent is slightly inferior to that of a heating arrangement by an inductor having a stationary magnetic field. Due to the invention, the cosine $\phi$ is improved even if a sliding magnetic field is used which results in savings, for instance at the electric condensators and thus at the cables used for supplying the electric current;

an improvement in the heating output which is especially notable if, according to the invention, the heating is produced by an inductor having a mobile magnetic field;

an improvement in the total heating output of the furnace, inasmuch as the improvement of the output of electric heating leads only to a small increase of the thermic losses, due to the reduction of the thickness of the refractory cover;

finally, an advantage specific in the case of an inductor with a sliding magnetic field is used, that is a reduction, even a suppression of the imbalance between the electric phases, responsible to what is called in the electrotechnique "the effects of extremities" peculiar to linear motors of induction. In fact, the possibility to reduce the air gap permits to correspondingly reduce the pole spacing of the inductor, while maintaining constant the value of relationship between the magnetic field created at the neighborhood of the inductor and the magnetic field acting to heat the product; otherwise said, the weakening of the magnetic field from the conductor up to the surface of the product to be heated is maintained constant.

It is thus possible to increase the number of pairs of magnetic poles for each phase of electric supply and therefore to correspondingly reduce the electric asymmetry between the entrance extremity and the egress extremity of the magnetic field, for instance the lower and upper extremities of the inductor if the magnetic field slides vertically from below to above.

It will be understood that each of the elements described above, or two or more together, may also find a useful application in other types of electric heating furnaces for inductive heating of metallic products differing from the types described above.

While the invention has been illustrated and described as embodied in an electric heating furnace for induction heating of metallic products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electric furnace for induction heating of metallic products comprising a planar inductor incorporated in a pair of transversely spaced walls and comprising in each wall a plurality of substantially parallel conductors alternatingly connected at opposite ends in order to produce a sliding magnetic field, said spaced walls defining between themselves a space into which the product to be heated is to be inserted; a thin layer of refractory material of about three centimeter thickness at that side of each wall which borders said space; and an independent cooling screen between each wall and the respective layer of refractory material, said cooling screen being constituted by a plurality of parallel adjacent non-magnetic metal tubes extending substantially normal to said conductors and being out of contact with each other to define between themselves electrically insulating spaces.

2. An electric furnace as defined in claim 1, wherein said cooling screen is constituted by an assembly of identical elementary units, each including a plurality of said tubes.

3. An electric furnace as defined in claim 2, wherein said tubes of each elementary unit are connected in series with each other to form a continuous cooling coil, and wherein said elementary units are connected in parallel with each other.

4. An electric furnace as defined in claim 3, wherein said tubes are connected at their ends to each other.

5. An electric furnace as defined in claim 1, and including an electric insulating material filling said insulating spaces between said tubes to impart rigidity to said screen.

6. An electric furnace as defined in claim 1, and including means for moving at least one of said walls together with the respective layer of insulating material and the respective screen toward and away from the other of said walls to vary the space between said walls so as to accommodate metal products of different size in said space.

7. An electric furnace as defined in claim 1, wherein said tubes are formed from stainless non-magnetic steel having an outer diameter of about 15 mm and a wall thickness of about 2 mm.

* * * * *